US009283602B2

(12) United States Patent
Flehmig et al.

(10) Patent No.: US 9,283,602 B2
(45) Date of Patent: Mar. 15, 2016

(54) PROCESS AND APPARATUS FOR PRODUCING A HOLLOW BODY, AND HOLLOW BODY

(75) Inventors: Thomas Flehmig, Ratingen (DE); Jörg Gorschlüter, Hamm (DE); Oliver Mertens, Essen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 552 days.

(21) Appl. No.: 12/738,343

(22) PCT Filed: Oct. 17, 2008

(86) PCT No.: PCT/EP2008/064047

§ 371 (c)(1),
(2), (4) Date: Jul. 19, 2010

(87) PCT Pub. No.: WO2009/050270

PCT Pub. Date: Apr. 23, 2009

(65) Prior Publication Data

US 2010/0294014 A1 Nov. 25, 2010

(30) Foreign Application Priority Data

Oct. 18, 2007 (DE) ..... 10 2007 050 337

(51) Int. Cl.

| | |
|---|---|
| ***B21C 37/18*** | (2006.01) |
| ***B21C 37/08*** | (2006.01) |
| ***B21D 22/02*** | (2006.01) |
| ***B21D 41/02*** | (2006.01) |

(52) U.S. Cl.

CPC ..... *B21C 37/185* (2013.01); *B21C 37/0815* (2013.01); *B21D 22/025* (2013.01); *B21D 41/02* (2013.01)

(58) Field of Classification Search

CPC ..... B21C 3/00; B21C 3/02; B21C 3/16; B21C 1/24; B21C 37/02; B21C 37/20; B21C 37/30; B21C 37/15; B21C 37/185; B21C 37/0815; B21B 25/00; B21D 22/025; B21D 41/02

USPC ..... 72/283, 352, 354.6, 359, 367.1, 368, 72/370.01, 370.23

See application file for complete search history.

(56) References Cited

U.S. PATENT DOCUMENTS

| | | | |
|---|---|---|---|
| 1,566,645 | A | 12/1925 | Breeze |
| 2007/0175261 | A1 | 8/2007 | Hornig et al. |

FOREIGN PATENT DOCUMENTS

| | | | |
|---|---|---|---|
| DE | 19827798 | A1 | 12/1999 |
| JP | 2005279706 | | 10/2005 |
| JP | 2006002898 | | 1/2006 |
| WO | 2004101187 | | 11/2004 |
| WO | 2005002753 | | 1/2005 |

OTHER PUBLICATIONS

International Search Report for International Application No. PCT/EP2008/064047.

*Primary Examiner* — Teresa M Ekiert

(74) *Attorney, Agent, or Firm* — Reinhart Boerner Van Deuren P.C.

(57) ABSTRACT

A process for producing a metal hollow body comprising a first axial portion with a first cross-sectional area and a second axial portion with a second cross-sectional area, and in which the two axial portions are connected to one another by means of a shape transition running in the axial direction, the method includes producing a preform body having at least one transition region which extends in the axial direction and is arranged between the first and second axial portions, wherein, in the transition region, the cross-sectional area of the preform body continuously changes from the cross-sectional area of the first axial portion into the cross-sectional area of the second axial portion, accommodating the preform body in a die, a shaping mandrel into the preform body, and axially moving the shaping mandrel to upset the preform body in the die into the final shape of the hollow body.

6 Claims, 1 Drawing Sheet

PROCESS AND APPARATUS FOR PRODUCING A HOLLOW BODY, AND HOLLOW BODY

CROSS-REFERENCE TO RELATED APPLICATIONS

This application is a National Phase Application of International Application No. PCT/EP2008/064047, filed on Oct. 17, 2008, which claims the benefit of and priority to German patent application no. DE 10 2007 050 337.9-14, filed on Oct. 18, 2007. The disclosures of the above applications are incorporated herein by reference in their entirety.

FIELD OF THE INVENTION

The invention relates to a method for producing a hollow body made of metal, which comprises at least one first axial portion with a first cross-sectional area and a second axial portion with a second cross-sectional area and in which both axial portions of the hollow body are connected to one another by means of a shape transition running in a radial plane. Furthermore, the invention relates to an apparatus for carrying out the method.

BACKGROUND

In the automobile industry and also in pipe fabrication, hollow bodies, which in the axial direction have large changes of cross-sectional shape over only a short axial length, for example from a small cross-section to a large cross-section, are frequently needed. The shape transition between the axial portions, having different cross-sectional shapes, of these hollow bodies therefore essentially runs in a radial plane. An exhaust system of a motor vehicle, which has a correspondingly designed hollow body in the region of the silencer, can be regarded as a typical example. Other hollow bodies are, for example, supporting ends of a frame structure of a motor vehicle or fittings of pipe systems. All these hollow bodies are frequently produced by means of a plurality of interconnected, in particular welded, metal sheets, which have been formed into a corresponding hollow body. The strength of the hollow bodies produced in this manner is, however, in need of improvement due to the multiplicity of the welding seams. In addition, welding seams are susceptible to corrosion and increase the cost of production. Furthermore, a multiplicity of production methods is known in order to produce corresponding hollow bodies with steeply angled shape transition from a tubular body, for example. For example, it is also possible to produce shape transitions running radially by pressing circular sheet-metal discs or deep-drawn preform bodies. However, these shape transitions generally can only be produced at the ends of tubes and result in a pronounced thinning-out of the sheet thickness. The same is also true for internal high-pressure shaping, which requires additional high investment with respect to the tools. The rolling-in technique known, for example, for producing hollow bodies of arbitrary cross-section from a blank only permits shape transitions which run axially over a longer transition region to be produced. Shape transitions essentially running in a radial plane cannot be produced using the rolling-in technique. Finally, a shape transition running in a radial plane may be produced by hot forming. However, this method is also cost-intensive, in particular due to the necessary heating.

The published Japanese patent application JP 2005279706 A furthermore discloses a method for producing a hollow body with a shape transition in which an axial portion with a reduced cross-sectional area is drawn from a portion with a larger cross-sectional area using a forming punch inserted into the hollow body. On the one hand, the shape transition between the smaller and larger cross-sectional area is not affected in the method but rather the smaller cross-sectional region is drawn out. Furthermore, the sheet thickness reduction is relatively large in the known method.

SUMMARY OF THE INVENTION

Proceeding from this basis, an aspect of the present invention is to provide a method and an apparatus for producing a generic hollow body which can be operated economically and with which hollow bodies having a high strength with shape transitions essentially running in a radial plane and with almost constant sheet thickness can be produced.

In a first teaching of the present invention, the above aspect is achieved with respect to the method in that a preform body is produced, which comprises at least one transition region extending in the axial direction of the hollow body to be produced and is arranged between the first and the second axial portion, wherein, in the transition region, the cross-sectional area of the preform body preferably continuously changes from the cross-sectional area of the first axial portion into the cross-sectional area of the second axial portion, the preform body is accommodated in a die, wherein the die has the final external shape of the hollow body to be produced, a shaping mandrel is inserted into the preform body, wherein the shaping mandrel has the internal shape of the hollow body to be produced and an axial movement of the shaping mandrel upsets the preform body in the die into the final shape of the hollow body.

Surprisingly, it has been shown that with the inventive method the sheet thickness reduction is minimal, since a flow of material, which considerably decreases the sheet thickness reduction in heavily formed areas, is created when the shape transition is upset or by upsetting the transition region of the preform body. The hollow body produced in this manner with a shape transition, essentially running in a radial plane, between two axial portions has a very homogeneous sheet thickness. On the one hand, the hollow body can be carried out very economically due to the method comprising two work steps, namely production of the preform body and upsetting of the preform body, while on the other hand the resultant hollow body has very good properties with respect to stability. Also, in the present patent application any shape transition which has a maximum deviation of +/−20° perpendicular to the axial direction is regarded as a shape transition essentially running in a radial plane. The shape transition essentially running in a radial plane takes place according to the invention between axial portions, having different cross-sectional areas, of the hollow body, thus for example between axial portions having a small and a large cross-section and/or between axial portions having different cross-sectional shapes, such as for example circular and multi-angled, of the hollow body.

The axial lengths of the axial portions of the hollow body to be produced with different cross-sectional areas can be of different lengths, preferably divided up into, for example, ⅓ to ⅔, for example, wherein ⅓ of the length relates to larger cross-sectional areas. With the known methods, up to now it was frequently only possible to incorporate shape transitions running radially in end regions into a tubular body, for example. In order to further increase the economy of the inventive method, provision is preferably made for the preform body to be produced from at least one blank for example using the rolling-in technique or by U-O forming. Both methods, the rolling-in technique and also U-O forming, are already established and permit hollow bodies, which can be used as preform bodies, to be produced economically. Both with the rolling-in technique and U-O forming, the formed blank is welded to one another in the edge area. In particular, the preform bodies produced using these methods also have very good forming properties due to the non-aggressive preliminary methods. In the second method step, the upsetting operation, large degrees of deformation can also still be obtained therewith.

Preferably the length of the transition region of the preform body is selected as a function of the wall thickness of the formed blank, the change in shape in the shape transition and as a function of the material. As a result, the process reliability of the inventive method can be further increased and in particular the sheet thickness change can be controlled by the inventive method. In order to achieve maximum degrees of deformation, the preform body should also be able to be produced by means of rolling-in technique or U-O forming.

The inventive method is particularly advantageous if the preform body, in at least one axial portion, has the external and internal shape of the hollow body to be produced. As a result, the upsetting operation is particularly simple, since the shaping mandrel can be slidably arranged in a simple manner in this axial portion of the preform body. Preferably tubular preform bodies are formed, so that fittings or parts of exhaust systems or supporting ends of a frame structure of a motor vehicle are produced in a simple manner.

In a further embodiment of the inventive method, function elements or secondary shaped elements are incorporated into the hollow body to be produced, so that subsequent incorporation of these elements can be dispensed with. Preferably, incorporation of the function elements and/or secondary shaped elements can be integrated in the die for producing the preform body or in the die for upsetting the shape transition and even in the shaping mandrel itself. Function elements or secondary shaped elements can, for example, be embossings, holes or lugs in the lateral surface of the hollow body. Other function elements are equally conceivable. In order to provide the necessary strength, preferably blanks made of steel, a steel alloy, in particular made of high-strength steels, are used for producing the preform body. In particular the inventive method permits high-strength steel to be used firstly, since overall no large degrees of deformation are needed for producing the hollow body.

In order to better adapt the hollow body to the particular application, it is advantageous if the preform body is produced from tailored blanks. Tailored blanks are sheet metal blanks adapted to the particular application, for example cut from sheet metal with different material thicknesses and/or material qualities.

In a second teaching of the present invention, the aspect indicated above is achieved by an apparatus in that a first die for producing a preform body from a blank using the rolling-in technique or the U-O forming method is provided, wherein the first die is configured so that the preform body comprises at least one transition region extending in the axial direction of the hollow body to be produced and arranged between the first and the second axial portion and, in the transition region, the cross-sectional area of the preform body preferably continuously changes from the cross-sectional area of the first axial portion into the cross-sectional area of the second axial portion, and at least one second die for accommodating the preform body that is produced is provided with a shaping mandrel, wherein the second die has the external final shape of the hollow body, the shaping mandrel has the internal final shape of the hollow body to be produced and the shaping mandrel is axially slidable relative to the second die.

With the inventive apparatus, the inventive method can be carried out economically, so that in regard to the advantages of the inventive apparatus, reference is made to the advantages of the inventive method. Furthermore, the necessary dies for producing the preform body and for upsetting the hollow body into its final shape do not require high investment and to this extent contribute to the economy of the method.

Further work steps can be avoided in a further embodiment of the inventive apparatus in that the first and/or the second die and/or the shaping mandrel comprises means for incorporating function elements and/or secondary shaped elements into the hollow body. These do not then have to be incorporated by additional work steps or apparatus.

A further advantageous embodiment of the inventive apparatus makes provision for means to be provided for automatically transporting a blank into the first die of the apparatus and/or means for inserting the preform body into the second die and/or means for removing the hollow body from the second die. The means in particular considerably improve the cycle times for producing the hollow body and to this extent result in a particularly economic manner of producing the hollow bodies.

In a third teaching of the present invention, the aspect indicated above is achieved by a hollow body made of metal, which comprises at least one first axial portion with a first cross-sectional area and a second axial portion with a second cross-sectional area and in which both axial portions of the hollow body are connected to one another by means of a shape transition essentially running in a radial plane, in that said hollow body is produced with the inventive method and the maximum sheet thickness change, in particular in the region of the shape transition, is +/−15%.

As stated above, the inventive method permits a hollow body with shape transition, essentially in a radial plane, between axial portions of different cross-sectional areas to be produced with particular care and attention and therefore enables particularly small sheet thickness changes of the hollow body.

Finally, hollow bodies with radial shape transition and having particularly high strength can therefore be provided in that the hollow body consists of steel, a steel alloy and/or high-strength steels. As already stated above, it is also entirely possible to use tailored blanks for producing the hollow bodies, so that the hollow body can be adapted to the stresses arising in service, at the same time having optimised weight. In particular, the use of high-strength steels means that the hollow bodies that are produced in this manner are adapted to high stresses.

BRIEF DESCRIPTION OF THE DRAWINGS

There are a plurality of possible embodiments of the method, the apparatus and the hollow body. For this purpose, reference is made for illustration purposes to the description of two exemplary embodiments in conjunction with the following drawings.

DETAILED DESCRIPTION

Figure 1:
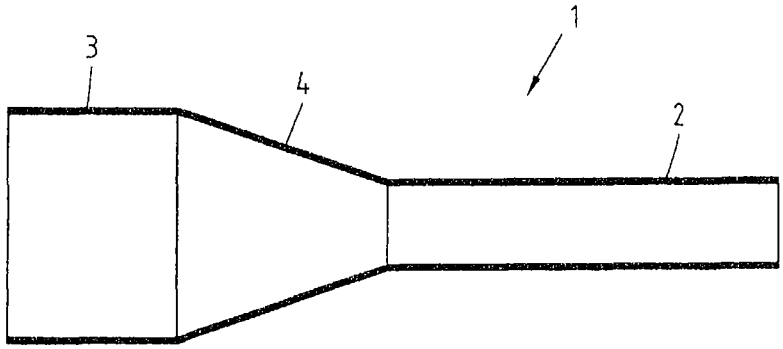
FIG. 1 in an axial sectional view the preform body of an exemplary embodiment of a hollow body produced according to the invention, FIG. 2 the second die for upsetting the preform body of an exemplary embodiment of an inventive apparatus before the preform body has been upset in a schematic axial sectional view and FIG. 3 the die from FIG. 2 after the preform body has been upset in a schematic axial sectional view.

In FIG. 1 firstly the preform body 1 is illustrated in a schematic, axial sectional view. The preform body has a first axial portion 2 with a first cross-sectional area and a second axial portion 3 with a second cross-sectional area. The cross-sectional area of the first axial portion 2 is smaller than the cross-sectional area of the second axial portion 3. In the transition region 4, extending in the axial direction, which is arranged between the two axial portions 2, 3, the cross-sectional area of the axial portion 2 changes into the cross-sectional area of the axial portion 3. In the exemplary embodiment illustrated, the shape transition is continuous or linear in the transition region 4 extending in the axial direction. However, other shape transitions are also conceivable. The preform body 1 shown in FIG. 1 can, for example, be produced using the rolling-in technique or U-O forming. In this case, the preform body, as also the finished hollow body, has a circular cross-section and is therefore particularly simply configured. As already stated, however, the shape transition can also take place between different cross-sectional shapes.

Figure 2:
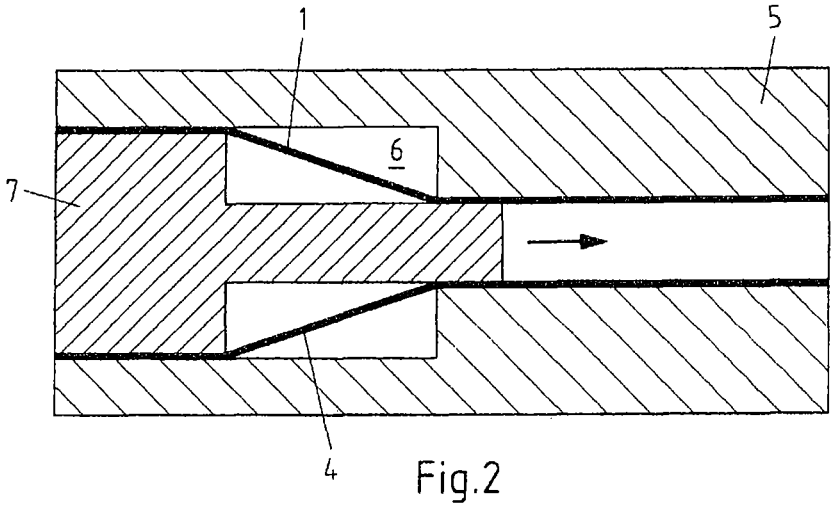
Figure 3:
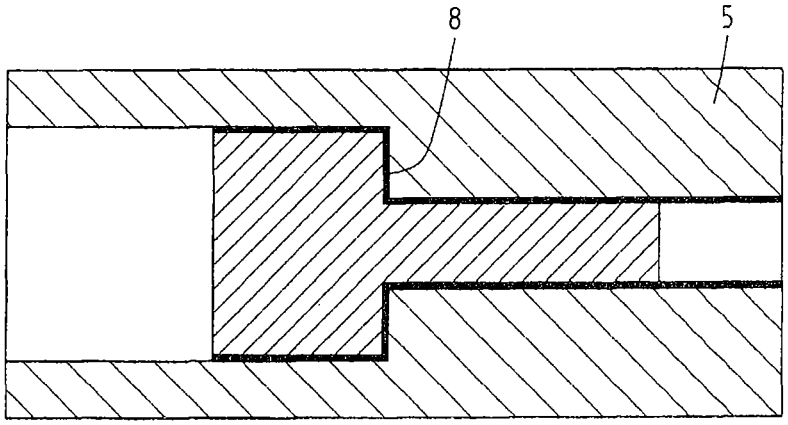

FIG. 2 now shows, in a schematic, axial sectional view, an exemplary embodiment of a die for upsetting the preform body 1 in order to carry out the inventive method. The die 5 has a matrix 6, which corresponds to the external shaping of the hollow body to be produced. The preform body 1 is already located in the die 5 of FIG. 2 and the shaping mandrel 7 inserted into the preform body 1. The shaping mandrel 7 can also have means—not illustrated—for incorporating function elements and/or secondary shaped elements into the hollow body. Further means—not illustrated—for incorporating function elements can also be provided in the die 5, but also in the shaping mandrel 7. The shaping mandrel 7 is now axially slided in the direction of the arrow, so that the transition region 4 of the preform body 1 is upset into the shape transition 8 of the hollow body. As a result, it is achieved that the sheet thickness change remains moderate despite the production of the shape transition 8 running radially and to this extent an improved hollow body with radial shape transition 8 can be provided, FIG. 3.

The invention claimed is:

1. Method for producing a hollow body made of metal, which comprises at least one first axial portion with a first cross-sectional area and a second axial portion with a second cross-sectional area and in which both first and second axial portions of the hollow body are connected to one another by means of a shape transition running in a radial plane, the method comprising:

producing a preform body, which comprises at least one transition region extending in an axial direction and is arranged between a first and a second axial portion of the preform body, wherein, in the transition region, the cross-sectional area of the preform body continuously changes from a first cross-sectional area of the first axial portion of the preform body into a second cross-sectional area of the second axial portion of the preform body;

selecting a length of the transition region of the preform body as a function of the wall thickness of the preform body, the change in shape in the shape transition, and as a function of material;

accommodating the preform body in a die, wherein the die has a final external shape of the hollow body, inserting a shaping mandrel into the preform body, wherein the shaping mandrel has the internal shape of the hollow body; and axially moving the shaping mandrel to upset the preform body in the die to complete the production of the hollow body, so that a maximum sheet thickness change in the axial directions of the hollow body is +/−15%.

2. Method according to claim 1, wherein the preform body is produced from at least one blank using a rolling-in technique or by U-O forming.

3. Method according to claim 1, wherein the preform body, in at least of the first and second axial portions, has the external and internal shape of the hollow body.

4. Method according to claim 1, further comprising incorporating function elements and/or secondary shaped elements into the hollow body to be produced.

5. Method according to claim 1, wherein blanks made of steel or a steel alloy are used for producing the preform body.

6. Method according to claim 1, wherein the preform body is produced from tailored blanks.

* * * * *